US010787000B2

(12) United States Patent
Lien

(10) Patent No.: US 10,787,000 B2
(45) Date of Patent: Sep. 29, 2020

(54) THERMAL PRINTHEAD HAVING ASYMMETRIC RECORDING ELEMENTS

(71) Applicant: Assa Abloy AB, Stockholm (SE)

(72) Inventor: Brent Lien, Minneapolis, MN (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/856,433

(22) Filed: Dec. 28, 2017

(65) Prior Publication Data

US 2019/0202213 A1 Jul. 4, 2019

(51) Int. Cl.
*B41J 2/335* (2006.01)
*B41J 2/355* (2006.01)
*B41J 2/36* (2006.01)

(52) U.S. Cl.
CPC ..... *B41J 2/3357* (2013.01); *B41J 2/3351* (2013.01); *B41J 2/3354* (2013.01); *B41J 2/33515* (2013.01); *B41J 2/33545* (2013.01); *B41J 2/355* (2013.01); *B41J 2/3551* (2013.01); *B41J 2/36* (2013.01)

(58) Field of Classification Search
CPC ..... B41J 2/3357; B41J 2/36; B41J 2/33545; B41J 2/3551; B41J 2/3351; B41J 2/355; B41J 2/33515; B41J 2/3354
See application file for complete search history.

(56) References Cited

U.S. PATENT DOCUMENTS 3,496,333 A 2/1970 Alexander et al.
5,420,612 A 5/1995 Brock et al.
5,742,300 A 4/1998 Klassen
5,926,201 A 7/1999 Fleming et al.
6,028,617 A 2/2000 Sawano et al.
6,326,990 B1 * 12/2001 Imai ..... B41J 2/33515 347/200
2001/0010535 A1 * 8/2001 Andoh ..... B41J 2/0057 347/213
2007/0120941 A1 5/2007 Nakanishi
2008/0117445 A1 5/2008 Masuda et al.

FOREIGN PATENT DOCUMENTS

EP 3505354 A1 7/2019
JP H01238956 A 9/1989
WO WO-2008118424 A1 10/2008

OTHER PUBLICATIONS

Kodak Versamark DS9100 and DS9050 Printing Systems brochure, Kodak, 2008. (2 pages).
"European Application Serial No. 18215063.1, Extended European Search Report dated Apr. 25, 2019", 8 pgs.
"European Application Serial No. 18215063.1, Communication Pursuant to Article 94(3) EPC dated Mar. 13, 2020", 4 pgs.

* cited by examiner

*Primary Examiner* — Justin Seo
(74) *Attorney, Agent, or Firm* — Schwegman Lundberg & Woessner, P.A.

(57) ABSTRACT

An asymmetric thermal print head includes a print head body and a plurality of print elements supported on the print head body. The print elements are aligned along a first axis. Each print element includes a heater portion having a burn width measured along the first axis corresponding to a first print resolution, and a burn length measured along a second axis, which is perpendicular to the first axis, corresponding to a second print resolution. The second print resolution is higher than the first print resolution. One or more control circuits are configured to individually activate the print elements.

18 Claims, 5 Drawing Sheets

THERMAL PRINTHEAD HAVING ASYMMETRIC RECORDING ELEMENTS

BACKGROUND

Thermal print heads are typically used to print images to substrates by heating portions of a thermal print ribbon having a transferable print consumable, such as colored dye, black resin, or other print consumable. The thermal print head includes a row of print elements. Each print element is configured to heat a pixel-sized portion of the print ribbon to transfer a corresponding image pixel of the print consumable to the substrate.

SUMMARY

Embodiments of the present disclosure are directed to an asymmetric thermal print head, a method of printing an image on a substrate using the asymmetric thermal print head, and a credential production device that includes the asymmetric thermal print head. Some embodiments of the asymmetric thermal print head include a print head body and a plurality of print elements supported on the print head body. The print elements are aligned along a first axis. Each print element includes a heater portion having a burn width measured along the first axis corresponding to a first print resolution, and a burn length measured along a second axis, which is perpendicular to the first axis, corresponding to a second print resolution. The second print resolution is higher than the first print resolution. One or more control circuits are configured to individually activate the print elements.

In some embodiments of the method, an image line is printed on a surface of the substrate by printing a plurality of pixels using the asymmetric print head. Each of the pixels has a pixel width measured along a first axis that is aligned with the image line, and a pixel length measured along a second axis that is perpendicular to the first axis. The print head is shifted relative to the substrate along the second axis a distance corresponding to the pixel length. These printing and shifting steps are repeated a limited number of times to complete the printing of the image on the substrate.

Some embodiments of the credential production device include a print ribbon, and the asymmetric thermal print head configured to print an image to a surface of a substrate using the print ribbon. The asymmetric thermal print head includes a print head body and a plurality of print elements supported on the print head body. The print elements are aligned along a first axis. Each print element includes a heater portion having a burn width measured along the first axis corresponding to a first print resolution, and a burn length measured along a second axis, which is perpendicular to the first axis, corresponding to a second print resolution. The second print resolution is higher than the first print resolution. One or more control circuits are configured to individually activate the print elements.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
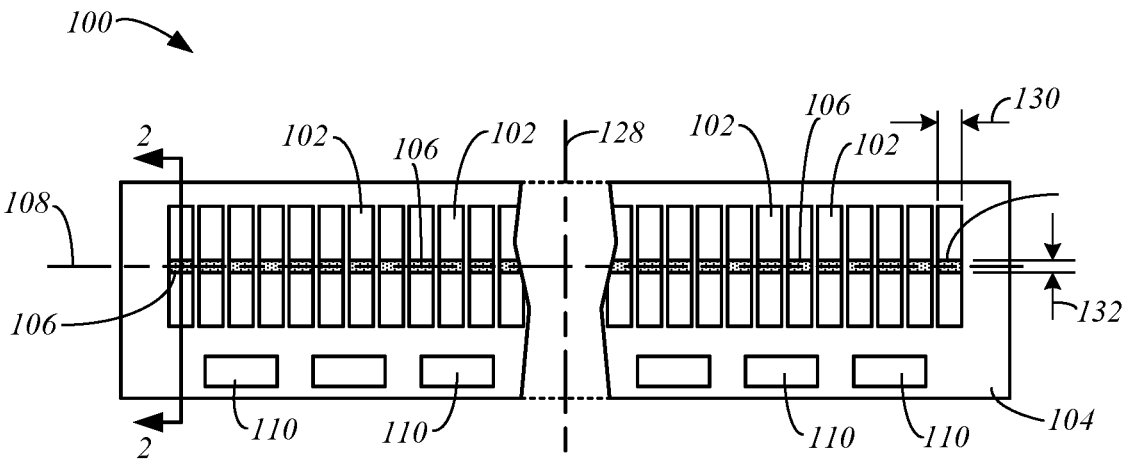
FIG. 1 is a simplified bottom view of an exemplary asymmetric thermal print head, in accordance with embodiments of the present disclosure.
Figure 2:
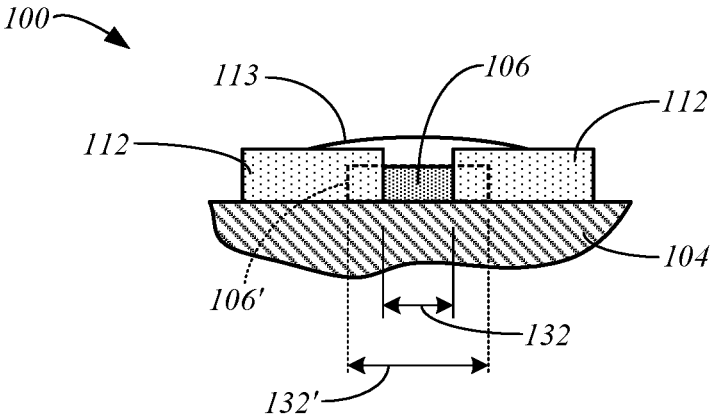
FIG. 2 is a simplified cross-sectional view of the print head of FIG. 1 taken generally along line 2-2.

FIG. 1 is a simplified bottom view of an exemplary asymmetric thermal print head 100 in accordance with embodiments of the present disclosure. FIG. 2 is a simplified cross-sectional view of the print head 100 taken generally along line 2-2. The print head 100 includes a plurality of print elements 102, which are supported on a print head body 104. Each of the print elements 102 includes a heater portion 106 that is generally aligned with a burn axis 108 to form a row of the heater portions 106 across a width of the print head body 104. In some embodiments, the heater portions 106 each include a resistive heating element that generates heat in response to an electric current.

The print head 100 also includes one or more control circuits 110, each of which is configured to selectively activate print elements 102 within a group. This activation of a print element 102 involves delivering a current to the heater portion 106 of the print element 102 through corresponding electrodes 112, in accordance with conventional thermal print head operations. The resistive heating element of the heater portions 106 generates heat in response to the current. A protective glaze 113 may be applied over the heater portions 106 to protect the heater portions 106, and provide a smooth contact surface, as shown in FIG. 2.

Figure 3:
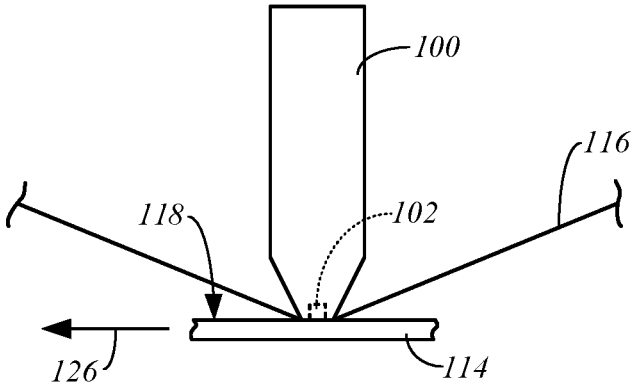
FIG. 3 is a simplified side view of an asymmetric thermal print head performing an exemplary print operation on a substrate using a print ribbon.
Figure 4:
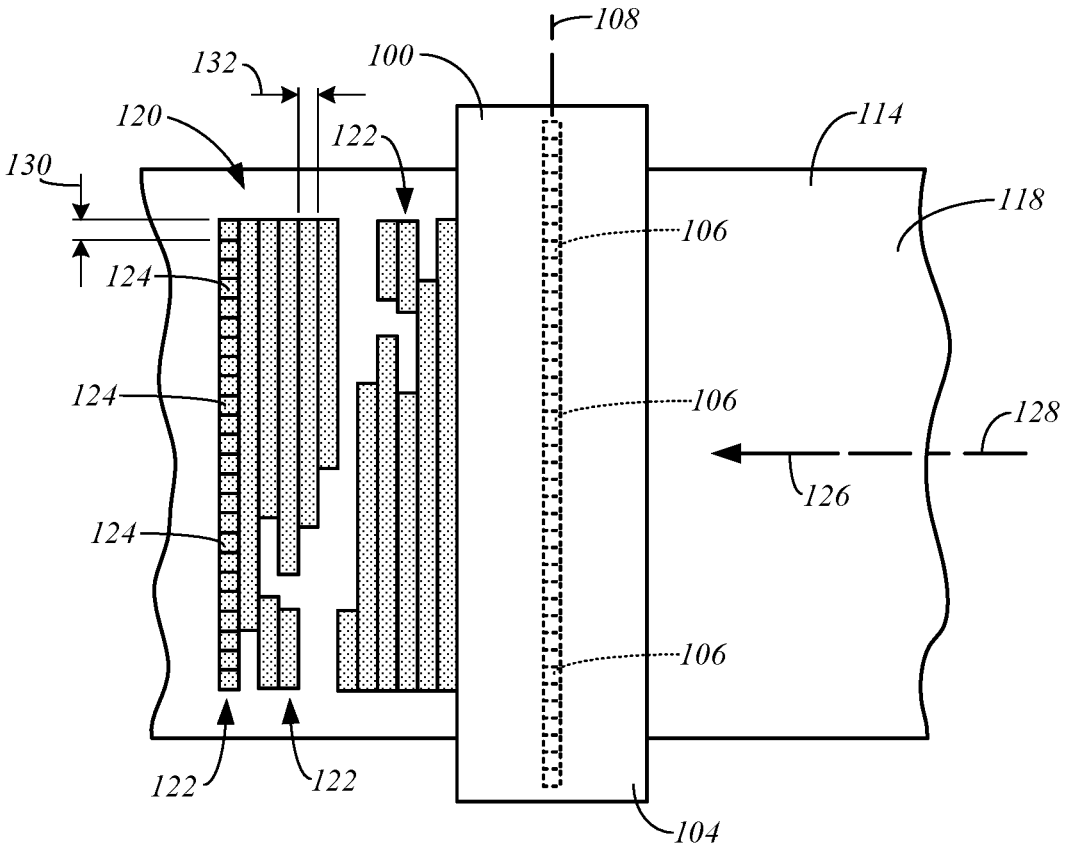
FIG. 4 is a simplified top view of the print operation of FIG. 3, but without the print ribbon.

The heat generated by the heater portions 106 of an activated print element 102 may be used to print an image to a substrate, as generally illustrated in FIGS. 3 and 4. FIG. 3 is a simplified side view of the print head 100 performing a print operation on a substrate 114 using a print ribbon 116, and FIG. 4 is a simplified top view of the print head 100 performing the print operation of FIG. 3, but with the print ribbon 116 removed.

The print ribbon 116 generally includes a print consumable attached to a carrier layer that may be transferred to the surface 118 of the substrate 114 from the carrier layer using the print head 100 during a print operation. The print consumable may take on any suitable form, such as a colored dye (e.g., yellow, cyan, or magenta), a black resin, or other print consumable, in accordance with conventional thermal print ribbons 116.

An image 120 may be printed to the surface 118 of the substrate 114 through the printing of several image lines 122 using the print head 100 and the print ribbon 116, as shown in FIG. 4. Each image line 122 of the image 120 is aligned with the burn axis 108, and comprises one or more pixels 124. Each pixel 124 is printed by activating a corresponding print element 102, using the control circuit 110. Heat generated by the heater portion 106 in response to the activation causes a print consumable to transfer from the print ribbon 116 to the surface 118 and form the pixel 124 of the image line 122. The print head 100 may then be shifted relative to the substrate 114 in the direction indicated by arrow 126 along an axis 128 to position the burn axis 108 in the position of the next image line 122, and the print elements 102 are selectively activated using the control circuits 110 to print the pixels 124 for the new image line 122. This process is repeated until the image 120 or a layer of the image 120 is printed to the surface 118 of the substrate 114. For some colored pixels 124 of the image 120, this printing process may be repeated to overlay different colored print consumables from the print ribbon 116 to the pixels 124 to form the desired colored pixels 124 of the image 120.

The heater portions 106 of the thermal print head 100 each have a burn width 130 measured along the burn axis 108, and a burn length 132 measured along the axis 128 that is perpendicular to the burn axis 108, as shown in FIG. 1. The burn width 130 corresponds to a width of the printed pixel 124, and the burn length 132 corresponds to a length of the printed pixel 124. Additionally, the burn width 130 corresponds to a print resolution along the burn axis 108, and the burn length 132 corresponds to a print resolution along the axis 128.

Figure 5:
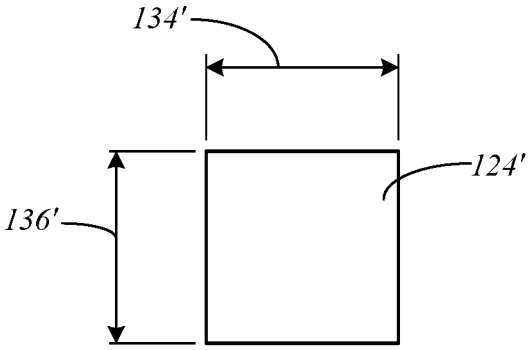
FIG. 5 (PRIOR ART)
FIG. 5 is a simplified top view of an exemplary pixel printed using a symmetric thermal print head in accordance with the prior art.

Conventional thermal print heads utilize print elements 102 having symmetric heater portions. That is, the burn width of the heater portions of conventional print heads substantially match their burn length. As a result, conventional symmetric thermal print heads are configured to produce symmetric pixels 124' each having a width 134' that substantially matches its length 136', as generally shown in FIG. 5, which is a simplified top view of an exemplary pixel 124' printed using a symmetric thermal print head in accordance with the prior art. Accordingly, a 300 dots-per-inch (dpi) conventional thermal print head generally has a 300 dpi resolution along both the burn axis 108 and the axis 128, and produces pixels 124' having a width 134' of 3.33 mil and a length 136' of 3.33 mil.

Figure 6:
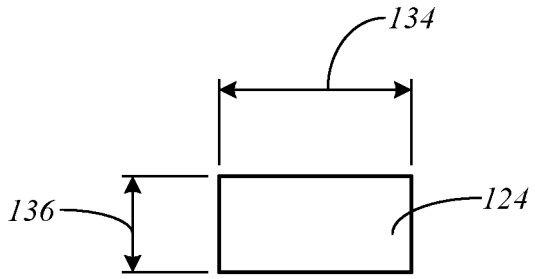
FIG. 6 is a simplified top view of an exemplary pixel printed using an asymmetric thermal print head, which is formed in accordance embodiments of the present disclosure.

The asymmetric thermal print head 100 of the present disclosure includes print elements 102 each having a burn width 130 that is different from the burn length 132. Thus, the print elements 102 of the asymmetric thermal print head 100 are configured to print asymmetric pixels 124, an example of which is illustrated in the simplified top view of FIG. 6. In some embodiments, the thermal print head 100 has a higher resolution along the axis 128 than along the burn axis 108. Thus, in some embodiments, the burn length 132 of the heater portions 106 is shorter than the burn width 130. Additionally, the burn length 132 is shorter than the burn length 132' of conventional heater portions 106' that substantially match the burn length 130, as indicated in phantom lines in FIG. 2. As a result, each pixel 124 printed using the asymmetric thermal print head 100 in accordance with embodiments of the present disclosure has a width 134 that is longer than its length 136, as shown in FIG. 6.

Figure 7:
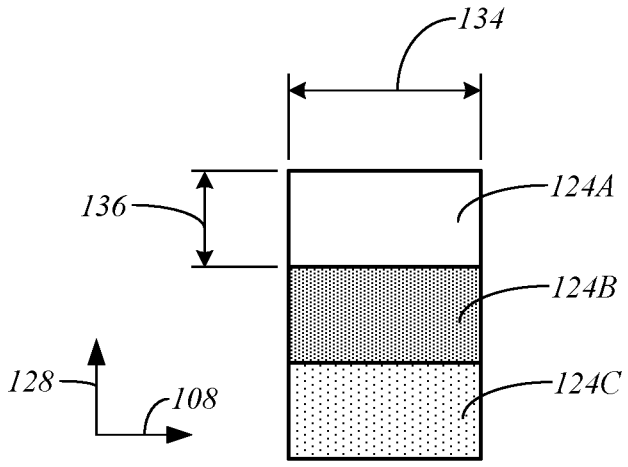
FIG. 7 is a simplified top view of an exemplary image printed using the asymmetric thermal print head.

Due to the dimensions of the burn portions 106, the print head 100 may perform a printing operation having a higher resolution along the axis 128 than along the burn axis 108, as shown in FIG. 7, which is a simplified top view of an exemplary image 120 printed using the asymmetric thermal print head 100. For instance, a first pixel 124A may be printed using one of the print elements 102 of the print head 100. The print head 100 may then be shifted along the axis 128 relative to the substrate a distance that is substantially equal to the burn length 132 of the heater portions 106, and a pixel 124B may then be printed. This may be followed by the printing of a pixel 124C after shifting the print head 100 by the burn length 132 along the axis 128 to complete the image 120 shown in FIG. 7. Here, the pixels 124A-C do not overlap and provide a higher printing resolution along the axis 128 relative to the print resolution along the burn axis 108.

In some embodiments, the print resolution of the asymmetric thermal print head 100 along the axis 128 is approximately double (e.g., ±10%) the print resolution along the burn axis 108, as generally shown in FIG. 2, where the asymmetric burn length 132 of the print head 100 is approximately one half (e.g., ±10%) of the corresponding symmetric burn length 132' of the symmetrically sized heater portion 106' (shown in phantom lines). In some embodiments, the thermal print head 100 is configured to have a 300 dpi print resolution along the burn axis 108, and a 600 dpi resolution along the axis 128. Thus, in some embodiments, the heater portions 106 of the thermal print head 100 generally have a burn width 130 of approximately 3.33 mil (e.g., ±10%), and a burn length 132 of approximately 1.67 mil (e.g., ±10%), and the pixels 124 printed by the print elements 102 have a width 134 of approximately 3.33 mil (e.g., ±10%), and a length 136 of approximately 1.67 mil (e.g., ±10%).

It should be noted that the thermal print head 100 provides a higher printing resolution along the axis 128 while using the same number of control circuits 110 required to provide the lower print resolution along the burn axis 108. This provides advantages over symmetric print heads that are configured to print at the higher resolution. For example, the asymmetric print head 100 requires fewer control circuits 110 than are required by the symmetric version, while providing the higher print resolution along the axis 128. This allows the asymmetric print head 100 to be produced at a significantly lower cost than the symmetric version.

Additional embodiments include methods of printing an image to a substrate using the asymmetric thermal print head 100, which is formed in accordance with one or more embodiments of the present disclosure. In the method, an image line 122 is printed on a surface 118 of a substrate 114 by printing a plurality of pixels 124, as discussed above and illustrated in FIGS. 3 and 4. Each of the pixels 124 has a width 134 (FIG. 6) measured along the burn axis 108, which is aligned with the image line 122, and a length 136 measured along the axis 128. The print head 100 is then shifted relative to the substrate 114 along the axis 128 in the direction 126 a distance corresponding to the pixel length 136 or burn length 132 of the heater portion 106. These printing and shifting steps are then repeated a limited number of times to print the image 120 to the surface 118 of the substrate 114. In some embodiments, the pixel width 134 corresponds to a first print resolution, and the pixel length 136 corresponds to a second print resolution that is higher than the first print resolution. In some embodiments, the pixel width 134 is approximately double (e.g., ±10%) the pixel length 136, and the second resolution is approximately double (e.g., ±10%) the first resolution. In some embodiments, the first print resolution is approximately 300 dpi (e.g., ±10%), and the second print resolution is approximately 600 dpi (e.g., ±10%). In some embodiments, the pixel width 134 is approximately 3.33 mil (e.g., ±10%), and the pixel length 136 is approximately 1.67 mil (e.g., ±10%).

Figure 8:
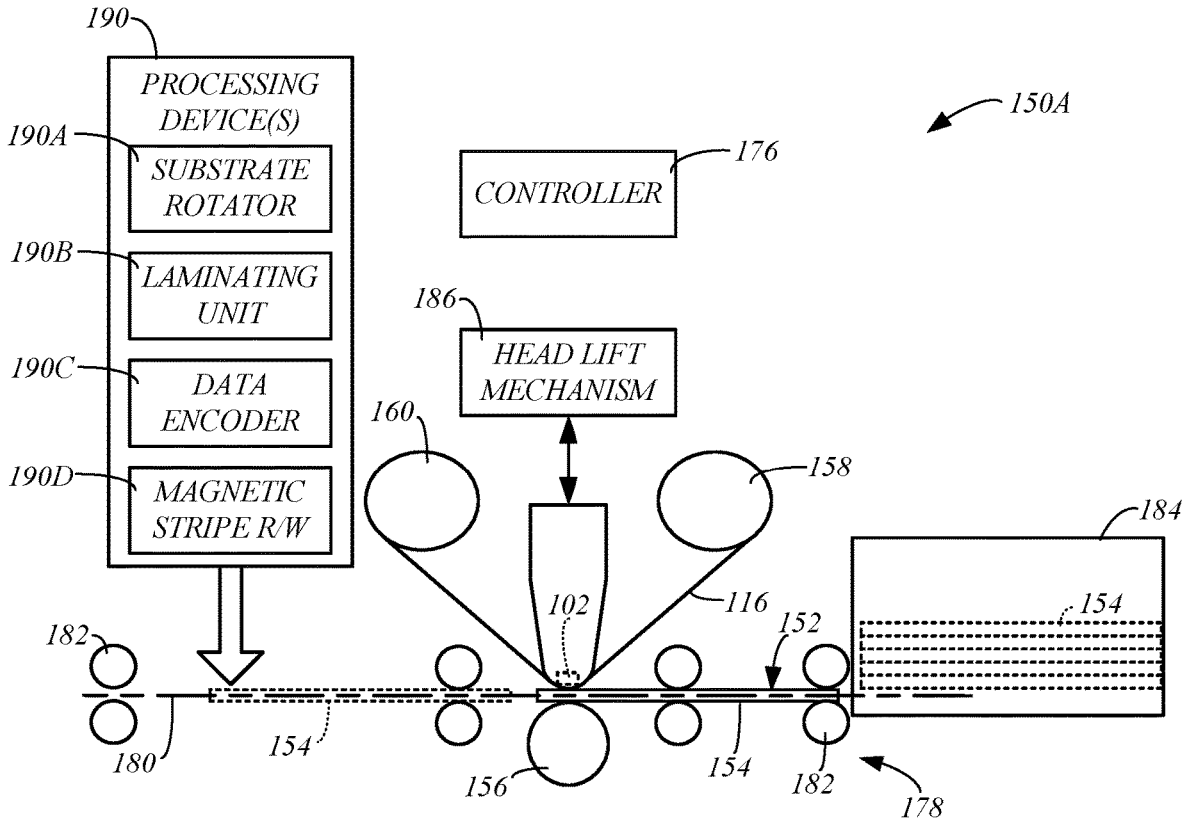
FIGS. 8 and 9 are simplified side views of exemplary credential production devices, in accordance with embodiments of the present disclosure.
Figure 9:
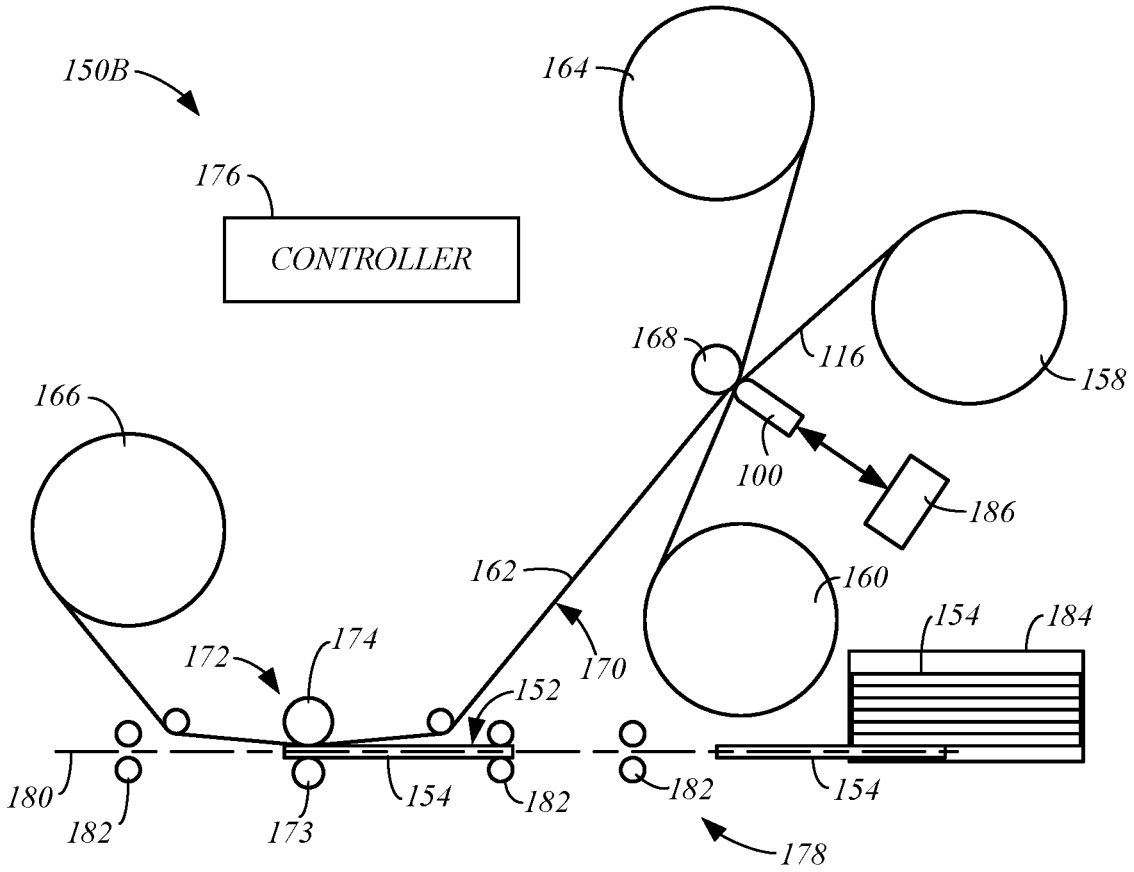

Some embodiments are directed to credential production devices that include the asymmetric thermal print head 100 formed in accordance with one or more embodiments of the present disclosure. FIGS. 8 and 9 respectively show simplified side views of exemplary credential production devices 150A and 150B in accordance with embodiments of the present disclosure.

The credential production device 150A is generally configured to directly print an image to a surface 152 of a substrate 154 using the asymmetric thermal print head 100 and a thermal print ribbon 116, as shown in FIG. 8. Here, the substrate 154 may form the final printed product. In some embodiments, the substrate 154 is a credential substrate. As used herein, the term "credential substrate" includes substrates used to form credentials, such as identification cards, membership cards, proximity cards, driver's licenses, passports, credit and debit cards, and other credentials or similar products. Exemplary credential substrates include paper substrates other than traditional paper sheets used in copiers or paper sheet printers, plastic substrates, rigid and semi-rigid card substrates and other similar substrates.

The substrate 154 is supported by a platen roller 156 or other suitable support, and the print ribbon 116, which may be supported between a supply spool 158 and a take-up spool 160, is positioned between the surface 152 and the print head 100, as shown in FIG. 8. The print elements 102 of the print head 100 are selectively activated to transfer pixels of a print consumable from the print ribbon to the surface 152 to print a series of image lines 122 and form the image 120 on the surface 118, such as shown in FIGS. 3 and 4 with regard to the substrate 114.

The credential production device 150B is generally configured to perform a reverse-image transfer printing process to print an image to the surface 152 of a substrate 154, such as a credential substrate, to form a final printed product. The print head 100 is configured to print the image to a transfer ribbon 162, which may be supported between a supply spool 164 and a take-up spool 166. The transfer ribbon 162 may be formed in accordance with conventional transfer ribbons and include a fracturable thin film laminate or overlaminate patches that may be transferred to a substrate 154. The print head 100 prints the image to the transfer ribbon 162, which is supported by a platen roller 168, by thermally transferring a print consumable from the thermal print ribbon 116 to a transferrable surface 170 of the transfer ribbon 162, such as shown in FIGS. 3 and 4 where the substrate 114 is the transfer ribbon 162. The imaged portion of the transfer ribbon 162 is then fed to a laminating unit 172, which transfers the printed image to the surface of the substrate 154, which may be supported by a platen roller 173, using a heated transfer roller 174 or other suitable laminating device, in accordance with conventional techniques.

The credential production devices 150A and 150B may each include additional components to facilitate the production of a credential product. For example, the devices 150A and 150B may include a controller 176 that is configured to control components of the devices 150A and 150B to perform one or more functions described herein, such as printing operations using the asymmetric thermal print head 100, for example. The controller 176 may represent one or more processors and memory (e.g., local or remote memory). The one or more processors are configured to control operations of the devices 150A or 150B in response to the execution of instructions contained in the memory.

In some embodiments, the devices 150A and 150B include a transport mechanism 178 configured to feed individual substrates 154 along a processing path 180. In some embodiments, the transport mechanism includes motorized feed rollers and/or pinch roller pairs 182 for driving the individual substrates 154 along the processing path 180 to the print head 100 (FIG. 8) for a printing operation, or to the laminating unit 172 (FIG. 9) for a transfer or lamination operation.

In some embodiments, the devices 150A and 150B include a substrate supply 184 containing a plurality of the substrates 154. The transport mechanism 178 may be configured to feed the individual substrates 154 from the supply 184 along the processing path 180, as shown in FIGS. 8 and 9, for example.

In some embodiments, the devices 150A and 150B include a head lift mechanism 186 that is configured to move the asymmetric thermal print head 100 either relative to the processing path 180 or platen roller 156 (FIG. 8), or the transfer ribbon 162 or platen roller 168 (FIG. 9).

The credential production devices 150A and 150B may also include other processing devices 190 that are configured to perform one or more processes on the substrate 154. These processing devices may include, for example, a substrate rotator 190A configured to rotate the substrate 154, a laminating unit 190B for the device 150A configured to apply an overlaminate to the surface 152 of the substrate 154, a data encoder 190C configured to read and/or write data to a memory chip of the substrate 152, a magnetic stripe reader and/or writer 190D configured to read and/or write data to a magnetic stripe of the substrate 154, and/or other suitable substrate processing devices.

Although the embodiments of the present disclosure have been described with reference to preferred embodiments, workers skilled in the art will recognize that changes may be made in form and detail without departing from the spirit and scope of the present disclosure.

What is claimed is:

1. An asymmetric thermal print head for printing images to a substrate by heating and transferring portions of a print ribbon to the substrate, the thermal print head comprising:

a print head body;

a plurality of print elements supported on the print head body and aligned along a first axis, each print element including a pair of electrodes that are spaced apart from one another and a discrete heater portion between and coupled to the pair of electrodes, the discrete heater portion having a burn width measured along the first axis and a burn length measured along a second axis that is perpendicular to the first axis, the burn length defined by a spacing between the pair of electrodes, wherein the burn length is shorter than the burn width, such that the print elements are configured to produce a first print resolution corresponding to the first axis that is lower than a second print resolution corresponding to the second axis; and one or more control circuits configured to individually activate the print elements and to produce the first print resolution along an axis of the substrate parallel to the first axis and the second print resolution along an axis of the substrate parallel to the second axis.

2. The thermal print head according to claim 1, wherein the second print resolution is approximately double the first print resolution.

3. The thermal print head according to claim 2, wherein the first print resolution is approximately 300 dpi, and the second print resolution is approximately 600 dpi.

4. The thermal print head according to claim 3, wherein the burn width of each heater portion is approximately 3.33 mil and the burn length of each heater portion is approximately 1.67 mil.

5. The thermal print head according to claim 1, wherein the print elements are divided into separate groups, the one or more control circuits includes a plurality of control circuits, and each control circuit is configured to control activation of individual print elements within one of the groups.

6. A method of printing an image on a substrate comprising:

printing an image line on a surf ace of the substrate comprising printing a plurality of pixels using an asymmetric thermal print head, each pixel having a pixel width measured along a first axis aligned with the image line, and a pixel length measured along a second axis that is perpendicular to the first axis;

shifting the print head relative to the substrate along the second axis a distance corresponding to the pixel length; and repeating the printing an image line and shifting the print head a limited number of times to complete the printing of the image on the substrate;

wherein the asymmetric thermal print head comprises:

a print head body;

a plurality of print elements supported on the print head body and aligned along a first print head body axis, each print element including a pair of electrodes that are spaced apart from one another and a discrete heater portion between and coupled to the pair of electrodes, the discrete heater portion having a burn width measured along the first print head body axis and corresponding to the pixel width and a burn length measured along the second axis and corresponding to the pixel length, the burn length defined by a spacing between the pair of electrodes, wherein the burn length and corresponding pixel length are shorter than the burn width and corresponding pixel width, respectively, such that the print elements are configured to produce a pixel arrangement along the first axis having a first print resolution that is lower than a second print resolution of a pixel arrangement along the second axis; and one or more control circuits configured to individually activate the print elements and to produce a lower print resolution along the first axis than the second axis.

7. The method according to claim 6, wherein printing the image line comprises printing pixels having a pixel width that is approximately double the pixel length, and the second print resolution is approximately double the first print resolution.

8. The method according to claim 7, wherein:

the pixel width is approximately 3.33 mil, and the pixel length is approximately 1.67 mil;

the first print resolution is approximately 300 dpi; and the second print resolution is approximately 600 dpi.

9. The method according to claim 8, wherein the burn width of each heater portion is approximately 3.33 mil and the burn length of each heater portion is approximately 1.67 mil.

10. The method according to claim 8, wherein printing the image line comprises selectively activating the resistive heating elements of the print elements to print the plurality of pixels.

11. The method according to claim 10, wherein:

the print elements are divided into separate groups;

the one or more control circuits includes a plurality of control circuits, and each control circuit is configured to control activation of individual print elements within one of the groups; and activating the resistive heating elements of the print elements comprises activating the individual print elements within each of the groups using one of the control circuits.

12. A credential production device comprising:

a print ribbon; and an asymmetric thermal print head configured to print an image to a surface of a substrate using the print ribbon, the print head comprising:

a print head body;

a plurality of print elements supported on the print head body and aligned along a first axis, each print element including a pair of electrodes that are spaced apart from one another and a discrete heater portion between and coupled to the pair of electrodes, the discrete heater portion having a burn width measured along the first axis and a burn length measured along a second axis that is perpendicular to the first axis, the burn length defined by a spacing between the pair of electrodes, wherein the burn length is shorter than the burn width, such that the print elements are configured to produce a first print resolution corresponding to the first axis that is lower than a second print resolution corresponding to the second axis; and one or more control circuits configured to individually activate the print elements and to produce the first print resolution along an axis of the substrate parallel to the first axis and the second print resolution along an axis of the substrate parallel to the second axis.

13. The device according to claim 12, wherein the second print resolution is approximately double the first print resolution.

14. The device according to claim 13, wherein the first print resolution is approximately 300 dpi, and the second print resolution is approximately 600 dpi.

15. The device according to claim 14, wherein the burn width of each heater portion is approximately 3.33 mil and the burn length of each heater portion is approximately 1.67 mil.

16. The device according to claim 15, further comprising a substrate processing device selected from the group consisting of a substrate rotator, a data encoder, a laminating unit, and a magnetic stripe reader and writer.

17. The device according to claim 12, wherein the substrate is a credential substrate and wherein the device further comprises:

a credential substrate supply containing a plurality of credential substrates; and a transport mechanism configured to feed credential substrates from the supply along a processing path.

18. The device according to claim 12, wherein:

the substrate is an intermediate transfer layer; and the device further comprises a laminating unit configured to laminate the intermediate transfer layer to a credential substrate.

* * * * *